US006557619B2

(12) United States Patent
Katoh

(10) Patent No.: US 6,557,619 B2
(45) Date of Patent: May 6, 2003

(54) INGOT SUPPLYING APPARATUS AND METHOD

(75) Inventor: Shinichi Katoh, Kanagawa-ken (JP)

(73) Assignee: Toshiba, Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/994,632

(22) Filed: Nov. 28, 2001

(65) Prior Publication Data

US 2002/0062940 A1 May 30, 2002

(30) Foreign Application Priority Data

Nov. 29, 2000 (JP) ..... 2000-363375

(51) Int. Cl.[7] ..... B22D 17/28

(52) U.S. Cl. ..... 164/270.1; 164/155.4; 164/155.2; 266/236; 222/591; 373/80

(58) Field of Search ..... 164/76.1, 270.1, 164/155.4, 452, 155.2; 266/236; 222/591; 373/80

(56) References Cited

U.S. PATENT DOCUMENTS 5,153,894 A * 10/1992 Ehle et al. ..... 373/80

6,334,975 B1 * 1/2002 Yokote et al. ..... 266/94

* cited by examiner

*Primary Examiner*—Tom Dunn
*Assistant Examiner*—I.-H. Lin
(74) *Attorney, Agent, or Firm*—Finnegan, Henderson, Farabow, Garrett, & Dunner, L.L.P.

(57) ABSTRACT

For improvement in production efficiency by elimination of a centering of an ingot supplier to an ingot supply opening upon reconnection of a melting and holding furnace to a die cast machine, there are provided an intermediate handler having a receiving case configured substantially in a channel shape open at both ends thereof, and pivoted on the furnace cover to be movable between a substantially horizontal lying position with one end thereof coincident with an ingot exit of the preheater to allow for a preheated ingot to be forward therein in a lying position with a longitudinal axis thereof set substantially horizontal and a substantially vertical standing position with the other end thereof coincident with the ingot supply opening to bring a distal end of the preheated ingot forwarded therein into abutment with the shutter to make the preheated ingot stand thereon, and an ingot supplier having a pawl chuck configured to enter inside the receiving case from an open side of the receiving case in the substantially vertical standing position, to be pressed against a rear end part of the preheated ingot as accommodated, and attached to, for a vertically guiding by, a drive mechanism fixed at a base end thereof to the furnace cover, and adapted for the shutter to be opened and the pawl chuck to be lowered to supply the preheated ingot into the melding and holding furnace.

3 Claims, 4 Drawing Sheets

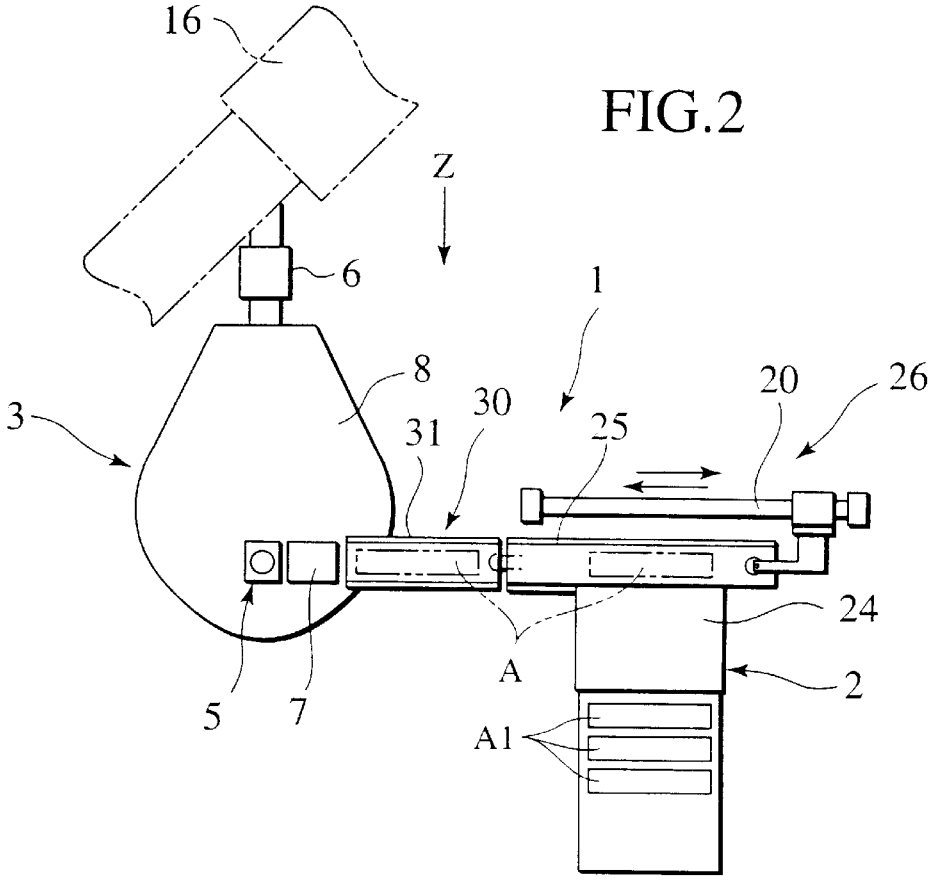
FIG.2
FIG.3
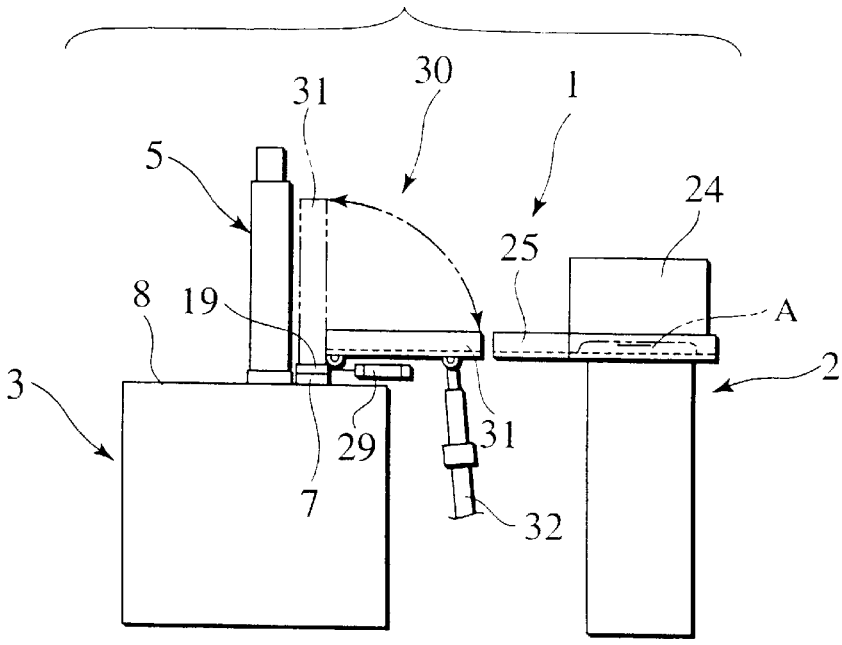

INGOT SUPPLYING APPARATUS AND METHOD

BACKGROUND OF THE INVENTION

1. Field of the Invention

The present invention relates to an ingot supplying apparatus for and an ingot supplying method of supplying a preheated magnesium ingot to a melting and holding furnace in which magnesium melt (in terms of a melt body of magnesium ingots) is held to be supplied to an injection sleeve of a die cast machine.

2. Description of Relevant Art

There have been disclosed in Japanese Patent Application Laying-Open Publication No. 2000-130958 such a type of magnesium ingot supplying apparatus and an associated magnesium ingot supplying method.

FIG. 1 shows the disclosed magnesium ingot supplying apparatus, which is generally designated by reference character 100 in the figure. The magnesium ingot supplying apparatus 100 has been proposed in consideration of various problems in an old art in which the ingot handling was performed by hands or in a relatively rough manner, such that a magnesium ingot laid on a supply guide, such as a roller conveyor, was simply pushed forward, for example by a cylinder, to the end, where it was thrown or fell directly into a pool of magnesium melt in a furnace, providing the melt with increased tendencies, for example, to be oxidized, lowered in temperature, and disturbed in level. The ingot supplying apparatus 100 has possibly suppressed such problems, in addition to an implemented automatic magnesium ingot supply leading to die cast products with an enhanced stable quality.

The ingot supplying apparatus 100 is roughly constituted with a preheater 2 for preheating magnesium ingots A, and an ingot supplier as an ingot supply mechanism 5 including an ingot chuck 4 for picking a preheated magnesium ingot A to be taken out of the preheater 2, carrying the picked ingot A to a position above magnesium melt M in a melting and holding furnace 3, and dipping and releasing the carried ingot A into the melt M, whereby this ingot A is supplied. The melting and holding furnace 3 inherently needs a periodical inspection, for example, once per three months. The periodical inspection requires a disconnection of the furnace 3 from a die cast machine 16, with the need of their reconnection after the inspection.

In FIG. 1, designated by reference character 6 is a magnetic hydraulic pump fitted on a goose-necked melt supply path of the furnace connected to the die cast machine; 7 is an ingot supply opening; 8 is a furnace top cover formed with the ingot supply opening; B is 4 surface level of the melt; 9 is a melt level detector; 10 is a float of the level detector; 11 is a sensing part of the level detector; and G is an antideflagrant gas filled over the melt for preventing deflagration of mnagnesium. The melting and holding furnace 3 is internally divided into an ingot melting chamber 12 (located at the right in the figure) and a melt holding chamber 13 (located at the left in the figure), by using a partition wall 15 separated for melt communication between the chambers 12 and 13.

The melting chamber 12 is covered by a right part of the top cover 8, where the ingot supply opening 7 is formed. The holding chamber 13 has, in a side wall thereof, a melt supply port 14 to be connected via the goose-necked supply path to the die cast machine 16. The ingot supply opening 7 is thus distant from the melt supply port 14, which means a difficulty for the opening 7 to well recover an original position after the inspection that needs a reconnection of melt supply path which tends to accompany a positional error. To this point, the ingot supply mechanism 5 has a support post 18 that provides a horizontal arm for slidably supporting a vertical feed screw, which carries the ingot chuck 4. The support post 18 is fixed in position and serves as a reference of the ingot supply mechanism 5. This mechanism 5 is a separate installation relative to the furnace 3. Accordingly, chuck operating parts of the ingot supply mechanism 5 need to be centered to the ingot supply opening 7 after every inspection, thus resulting in a reduced working efficiency, yet leading to a reduced production efficiency.

Further, a chuck part 4*a* of the ingot chuck 4 keeps holding a magnesium ingot A until the most part of the ingot A gets dipped in the magnesium melt M. Therefore, not simply the chuck part 4*a,* but also a driving part 4*b* directly linked to the chuck part 4*a* is exposed to an atmosphere as hot as approx. 400° C., so that an entirety of the ingot chuck 4 suffers a reduced durability.

Still more, the ingot supplying apparatus 100, in which ingots A need to stand upright to be heated in the preheater 2, has an ingot carrier 17 adapted to hold the ingots A standing with their longitudinal axis upright, in addition to other considerations, with significant complexity resulting in high cost.

SUMMARY OF THE INVENTION

The present invention has been made with such points in view. It therefore is an object of the present invention to provide an ingot supplying apparatus and an ingot supplying method, which are free from centering an ingot supplying implement to an ingot supply opening upon reconnection of a melting and holding furnace to a die cast machine, such as after inspection, thus achieving an increased production efficiency, and which additionally allow for an ingot handling implement to have an increased durability, and for a preheater to be simplified in structure with a reduced cost.

To achieve the object, according an aspect of the invention, there is provided an ingot supplying apparatus for supplying a preheated magnesium ingot from a preheater to a melting and holding furnace, the apparatus comprising: an ingot supply opening provided to a furnace cover of the melting and holding furnace and with a shutter operable to open and close by an external signal; an intermediate handler having a receiving case configured substantially in a channel shape open at both ends thereof, and pivoted on the furnace cover to be movable between a substantially horizontal lying position with one end thereof coincident with an ingot exit of the preheater to allow for a preheated ingot to be forward therein in a lying position with a longitudinal axis thereof set substantially horizontal and a substantially vertical standing position with the other end thereof coincident with the ingot supply opening to bring a distal end of the preheated ingot forwarded therein into abutment with the shutter to make the preheated ingot stand thereon; and an ingot supplier having a pawl chuck configured to enter inside the receiving case from an open side of the receiving case in the substantially vertical standing position, to be pressed against a rear end part of the preheated ingot as accommodated, and attached to, for a vertically guiding by, a drive mechanism fixed at a base end thereof to the furnace cover, and adapted for the shutter to be opened and the pawl chuck to be lowered to supply the preheated ingot into the melding and holding furnace.

According to another aspect of the invention, there is provided an ingot supply method using an ingot supplying apparatus according to the previous aspect, wherein a magnesium ingot is set in a substantially horizontal lying position with a longitudinal axis thereof substantially horizontal, preheated in the preheater, and thereafter forwarded, with the lying position maintained, via the ingot exit of the preheater, into the receiving case of the intermediate handler in the substantially horizontal lying position, and thereafter is placed, by having the receiving case set in the substantially vertical standing position, on the shutter, in a vertical position with a distal end thereof on the shutter, and held by the pawl chuck of the ingot supplier pressed against a rear end part thereof, and thereafter, with the shutter opened, is dipped in respect of a most part thereof, by a vertical lowering movement of the pawl chuck at a low speed, into a magnesium melt in the melding and holding furnace, before a release thereof for supply.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIG. 2 is a plan of a magnesium ingot supply system as an apparatus according to an embodiment of the present invention;

FIG. 3 is a front elevation of the ingot supply system of FIG. 2;

DETAILED DESCRIPTION OF THE PREFERRED EMBODIMENTS

Figure 1:
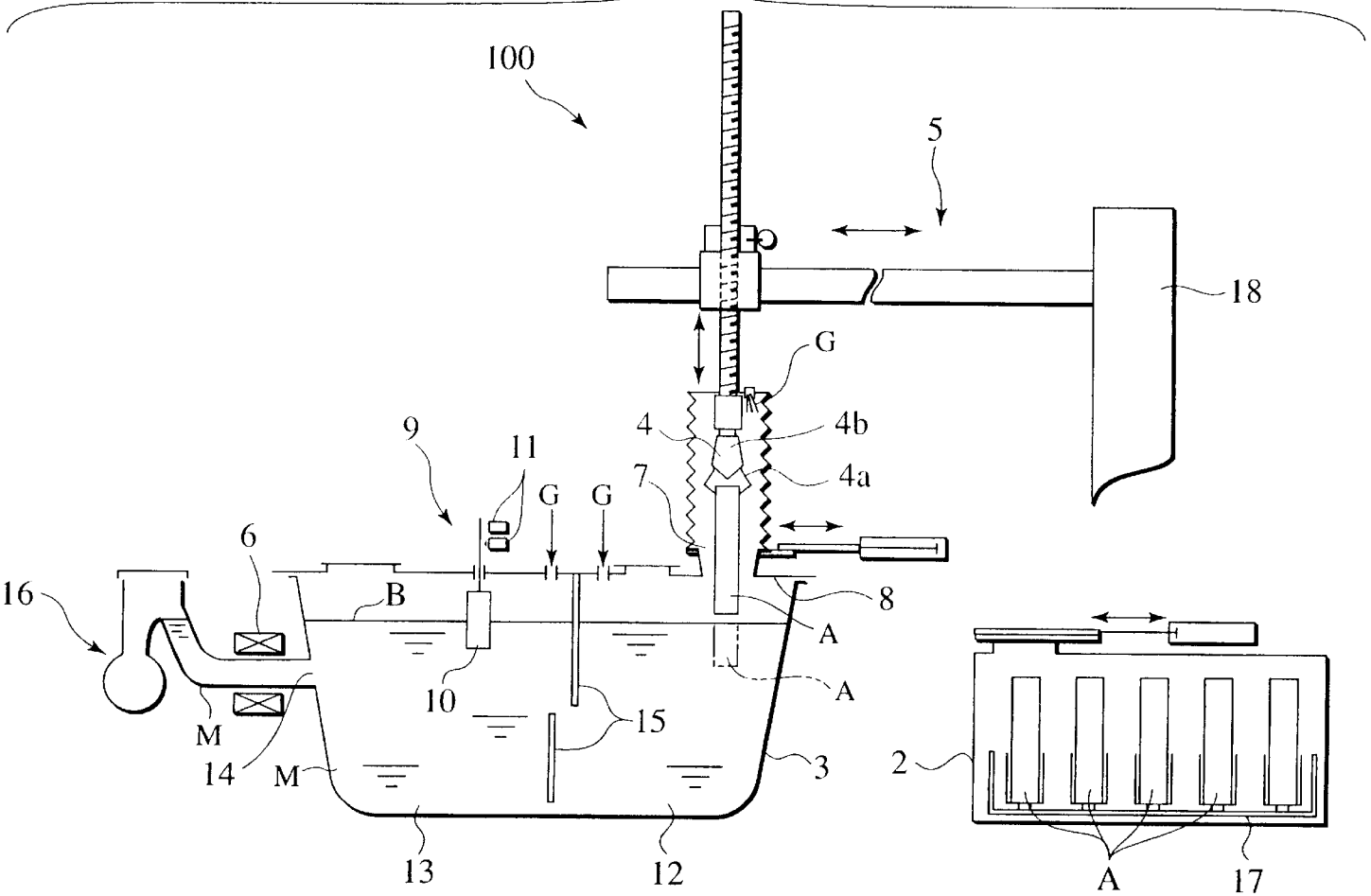
FIG.1 PRIOR ART
FIG. 1 is a schematic illustration of a conventional magnesium ingot supplying apparatus equipped as a separate installation to an improved type of ingot heating and melt holding furnace connected to a die cast machine.

There will be detailed below the preferred embodiments of the present invention with reference to the accompanying drawings. Like members and elements to FIG. 1 are designated by like reference characters.

FIG. 2 and FIG. 3 schematically show a magnesium ingot supply system 1 as an apparatus according to an embodiment of the invention. The supply system 1 is adapted to supply a preheated magnesium ingot A from an ingot preheater 2 to an ingot melting and melt holding furnace 3, and include: the preheater 2; an intermediate ingot handler 30 as a mechanism or means for receiving, at a reception case 31 thereof, a preheated ingot A forward therein from the preheater 2, and controlling the attitude or position of the ingot A; and an ingot supplier 5 as a mechanism or means for supplying the ingot A controlled in position into an ingot supply opening 7 provided in a pear-shaped top lid 8 of the melting and holding furnace 3. In FIG. 2, designated by reference character 6 is a magnetic hydraulic pump fitted on a goose-necked melt supply path, 16 is a die cast machine as a separate installation, and A1 is a magnesium ingot to be heated at the preheater 2.

Figure 4:
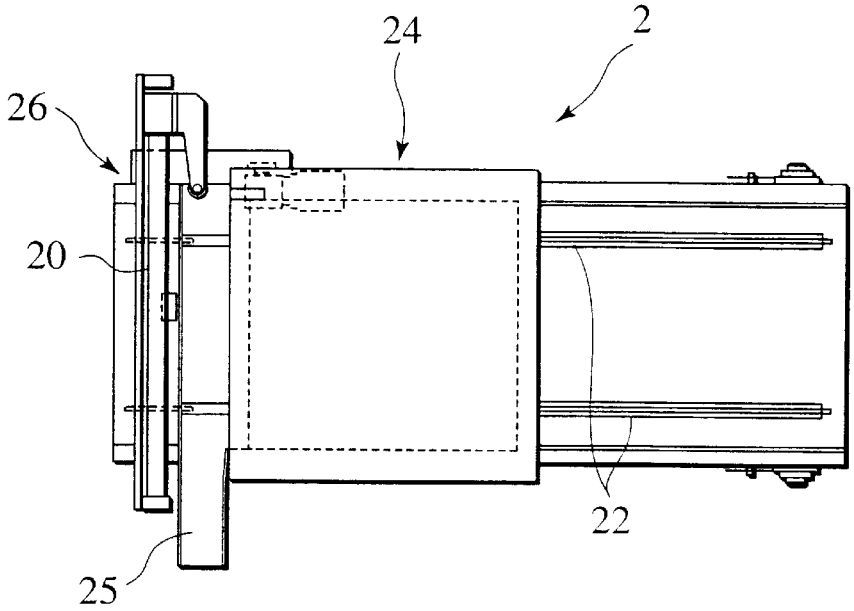
FIG. 4 is a plan of a preheater of the ingot supply system of FIG. 2.
Figure 5:
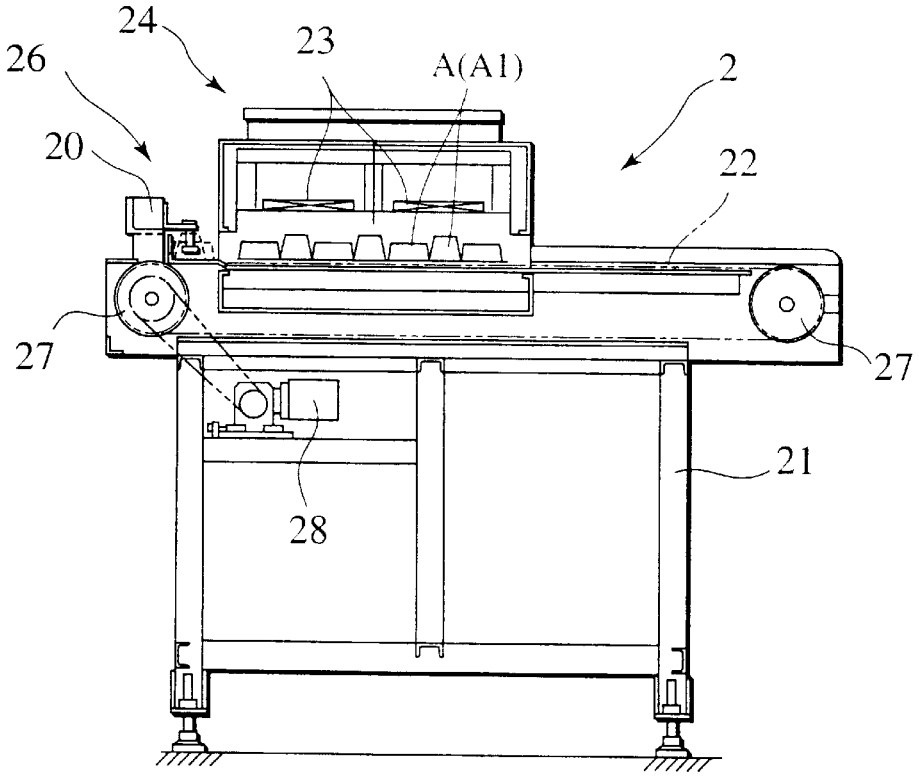
FIG. 5 is an elevation of the preheater of FIG. 4.

FIG. 4 and FIG. 5 show the ingot preheater 2, which include: a stand 21 as a supporting base with a receiving bed for receiving a magnesium ingot A1 laid on a front (right in FIGS. 4–5, front in FIGS. 2–3) half thereof, with a longitudinal axis set substantially horizontal; a chain conveyor 22 for moving the laid ingot A1 forward, the chain conveyor 22 extending over bed length of the stand 21; a heating chamber 24 as a tunnel, batch, pit or other means having incorporated heaters or heating elements 23 for preheating the forwarded ingot A1, the heating device 24 substantially covering a rear (left in FIGS. 4–5, rear in FIGS. 2–3) half of length of the chain conveyor 22; and an ingot holding unloader 26 as a mechanism or means installed at the rear end of the chain conveyor 22 for holding a preheated ingot A waiting, the unloader 26 having a rod-less cylinder 20 for pushing the ingot A forward into an ingot exit 25, toward the ingot handler 30.

In FIG. 5, designated by reference character 27 is a respective sprocket for driving the conveyor 22, and 28 is an electric motor for driving the sprocket 27 to drive the conveyor 22.

Figure 6:
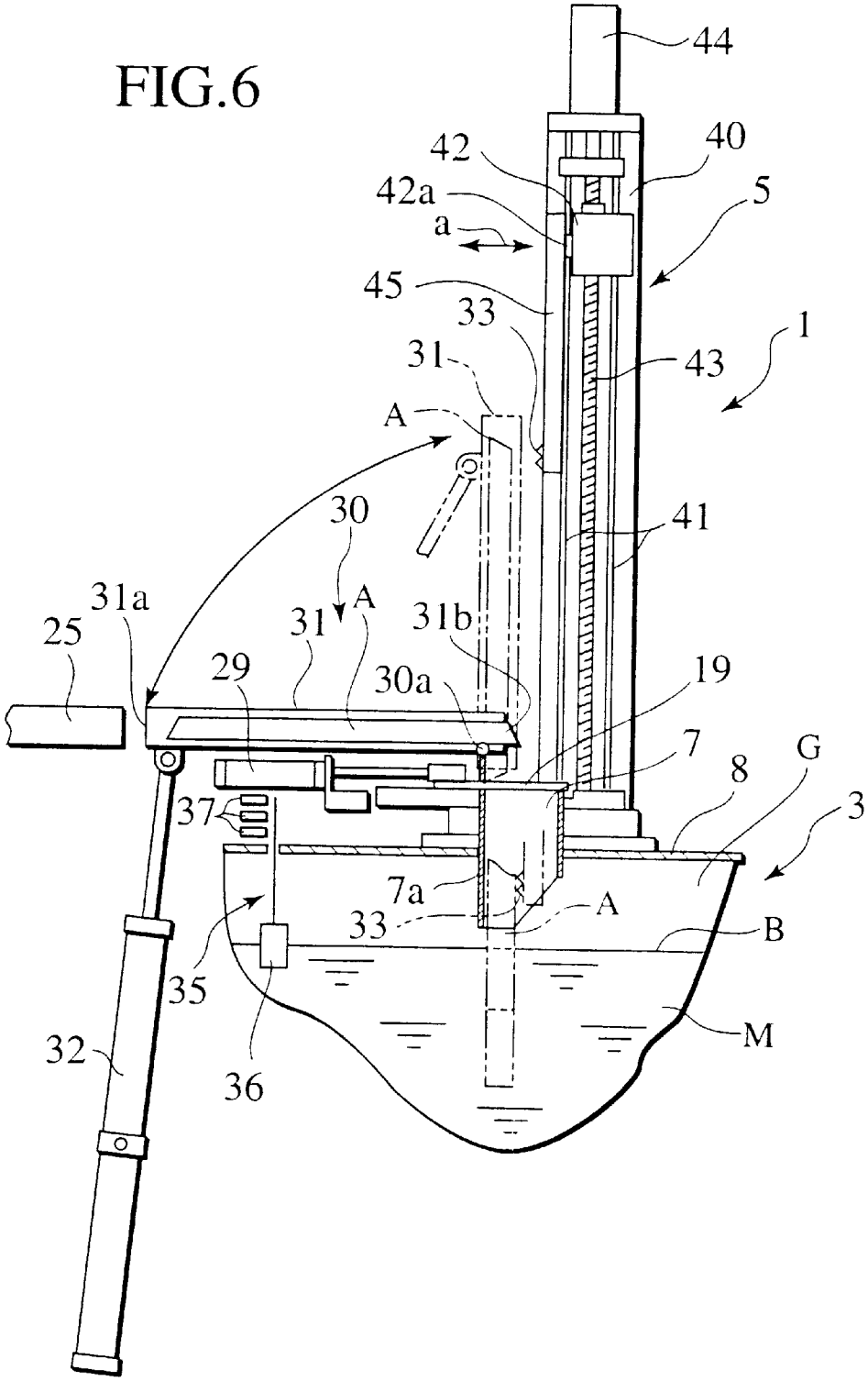
FIG. 6 is a detailed backside view along an arrow Z (rotated at 180°) of FIG. 2.

FIG. 6 shows the melting and holding furnace 3, which is substantially the same as or similar to the improved type illustrated in FIG. 1. An open top of the furnace 3 is totally closed by a top cover 8, and a space left between the top cover 8 and a surface level B of magnesium melt M in the furnace 3 is filled with an antideflagrant gas G. The surface level B is detected by a level detector 35 having a float 36 floating on the melt M, and a sensing part 37 formed by sensing elements cooperatively sensing a vertical position of an index bar fixed to the float 36 and projecting above the top cover 8.

The ingot supply opening 7 comprises a tubular prism-shaped port member as an ingot guide **7*a* provided through the top cover 8, and a horizontal shutter 19 operative with an external control signal for opening and closing a polygonal open top end of the guide 7*a*. The control signal may be a direct or indirect detection signal of the surface level B, as it is detected by the level detector 35, or nay be an operation signal such as from a pushbutton switch operative by a worker observing the level B. The shutter 19 has a drive cylinder 29 controlled by the external control signal. It is noted that the top end of the guide 7*a*, cab be hermetically sealed by the shutter 19** to prevent escape of magnesium vapor as well as release of antideflagrant gas G.

The guide **7*a* is joined tight at an upper part thereof to the top cover 8, and cut oblique at a lower end thereof, more specifically at such a side of this lower end that is nearer to the ingot supplier 5 than the opposite side thereof the guide 7*a* protects an ingot handling member from direct exposure to surrounding atmosphere or occasionally violent melt, allowing an ingot A to be held, such as by chucking, until the handling member comes down near the surface level B. The shutter 19 or guide 7*a* may preferably be provided with a necessary number of air or gas curtains to seal an ingot passage therein when a standing ingot A enters the passage. It is noted that antideflagrant gas G is supplied under pressure so that small clearances about the ingot A (as well as associated chuck remembers) is effectively sealed. In the case the ingot A is constant in sectional size, the passage of the guide 7*a* or the top end thereof may be configured to fit sufficiently tight on the ingot A (as well as associated chuck members). A set of the ingot supplier 5, the ingot handler 30, and the ingot supply opening 7 or a subset thereof including the supply opening 7 may be covered by an effectively sealing elastic or flexible member, like the case of FIG. 1**.

The ingot handler 30 comprises a channel-shaped receiving or carrying case 31 configured to be open at a distal (left in FIG. 6, right in FIGS. 2–3) end 31*a* thereof and a base (right in FIG. 6, left in FIGS. 2–3) end 31*b* thereof for smooth reception and escape of a preheated ingot A, and to be vertically swingable or angularly movable about the base end 31*b* pivoted at a pivot 30*a* on the top cover 8, between a horizontal or lying position (solid lines in FIG. 6), where the distal end 31*a* coincides in center position with the ingot exit 25 to receive a lying preheated ingot A unloaded or forwarded therefrom, and a vertical or standing position (two-dot and dash lines in FIG. 6), where the base end 31*b* coincides in center position with the ingot supply opening 7 and the forwarded ingot A stands upright with its distal or lower end abutting on the shutter 19. The case 31 configured in a channel-shape has a bottom side closed with a bottom wall, and a top side open to outside. In the lying position, the bottom side is disposed below the top side as a matter of course. In the standing position, the top side is disposed nearer to the ingot supplier 5 than the bottom side. The case 31 is actuated by expansion and contraction of a cylinder 32, which is installed outside the furnace 3 and operatively connected at its distal or upper end of its piston rod to the distal end 31*a* of the case 31. Note that the ingot A as well as A1 is tapered at both lateral sides and at both front and rear ends, as depicted in FIG. 5 and FIG. 6, and a greater bottom side of the ingot A is placed on the bottom wall of the case 31, with a smaller top side exposed outside the case 31.

The ingot supplier 5 comprises: a pawl chuck 33 comprised of a combination of chucking pawls configured to enter into the open side of the case 31, to be pressed (as depicted in FIG. 6) against a near side (the top side in the lying position) of an upper endpart of the standing ingot A, for cooperation with the closed side (the bottom side in the lying position) of the case 31 to chuck or hold therebetween the ingot A to be slid under force along the bottom wall of the case 31; and a chuck drive 40 as a vertically extending mechanism mounted on the furnace top cover 8 for driving the chuck 33 to move therealong, after an opening operation of the shutter 19, to vertically displace the standing ingot A to be supplied so that this ingot A is gradually or inchingly dipped into the magnesium melt M.

The chuck drive 40 comprises: a pair of guide posts 41 standing upright on the top cover 8; a chuck pressing cylinder 42 vertically movable along the guide posts 41, as it is guided by these posts 41; a screw shaft 43 threaded to a housing of the cylinder 42, and adapted for forward and reverse rotations to vertically displace the cylinder 42; and an electric drive motor 44 for driving the screw shaft 43 into forward and reverse rotations.

The chuck 33 is fixed to a lower end of a laterally pressing connection rod 45 to be inserted together into the ingot supply opening 7, as shown in FIG. 6. The chuck pressing cylinder 42 has a piston rod 42*a* fastened to an upper end of the connection rod 45. As the piston rod 42*a* expands or contracts (as shown by arrow "a" in FIG. 6), the chuck 33 moves leftward or rightward in the figure, pressing or releasing the preheated ingot A to be pinched in or free from between the chuck 33 and the bottom wall of the case 31.

It is noted that respective drives are controlled by their controllers or from a supervisory controller (not shown) of the ingot supply system 1. The supply system 1 is operated in accordance with the invention, as follows:

First, at the preheater 2, a cold magnesium ingot A1 to be preheated is horizontally laid on a front end (the near or lower end in FIG. 2) of the front half of the chain conveyor 22, forming a tail of a column of ingots A and A1 laterally laid on the conveyor 22. Such ingots A1 may first be placed at intervals as shown in FIG. 2, and in due course may be brought into close contact as shown in FIG. 5. The ingots A, A1 may be irregular in length and sectional size, as illustrated in FIG. 5, and may be spaced by inserting distance pieces. As the conveyor 22 is rotated forward, the ingot column is advanced rearward (leftward in FIG. 5) so that those ingots A1 and A positioned in a rear (left in FIG. 5) half of the ingot column, excepting a most preheated leading ingot A, are placed in the heating chamber 24, where they are preheated to approx. 150° C., whereby adherent moisture thereon is removed. The leading ingot A is then placed in position on an expel passage of the unloader 26.

The preheated ingot A placed on the unloader 26 is pushed to be expelled through the exit 25 by the rod-less cylinder 20, so that it is forwarded in the case 31 in a horizontal lying position in the ingot handler 30, as shown in FIG. 2. The above-noted forward-in operation may be performed by sending a supply command from the furnace 3 (for example, a detection signal of a lowered melt level B detected by the level detector 35) to a controller of the rod-less cylinder 20. The supply command may then be sent to the motor 44 (FIG. 6) of the screw shaft 43 in the chuck drive 40 so that the chuck 33 (FIG. 6) is set in position before pressing the ingot A. Further, like command may be sent with a delay to a controller of the cylinder 32 (FIG. 6) of the case 31 and to a controller of the cylinder 42 (FIG. 6) of the chuck 33, and with a longer delay to the drive cylinder 29 (FIG. 6) of the shutter 19.

Then, as shown in FIG. 3 and FIG. 6, the case 31 is rotated about the pivot 30*a* (FIG. 6) by the cylinder 32, so that it is set to a vertical standing position (phantom lines), whereby the preheated ingot A is likewise rotated to stand upright on the shutter 19, with the distal or lower end abutting on the shutter 19. Concurrently, the cylinder 42 of the chuck 33 is operated to horizontally press pawls of the chuck 33 against a top part of the standing ingot A, thereby holding the ingot A. For an ingot A irregular in length and section, the chuck 33 is appropriately controlled in vertical and/or horizontal position, by adjusting vertical displacement of the cylinder 42 and/or horizontal extension of the piston rod 42*a*.

Then, the shutter 19 is operated by the cylinder 29 to open the ingot supply opening 7, where the preheated ingot A is vertically introduced, as it is driven to be slid down by the chuck 33 along the guide 7*a*. As the chuck 33 is slowly lowered along the screw shaft 43, the ingot A vertically goes down at a corresponding speed, to be dipped in the magnesium melt M in the melting and holding furnace 3. When most of the ingot A is dipped in the melt M, the chuck 33 is operated by the cylinder 42 to release the ingot A, which is thereby wholly supplied in the melt M.

More specifically, when the shutter 19 opens, the chuck 33 starts going down together with the chuck pressing cylinder 42, whereby the preheated ingot A is smoothly lowered to "a level at which the lower end of the ingot A substantially contacts a current surface level B of the magnesium melt M" (hereinafter called "ingot dipping start level"), where the ingot A is once stopped. Till then, the lowering of the ingot A is controlled in dependence on a detection signal of the surface level B from the level detector 35.

At the ingot dipping start level, there starts an ingot lowering control for carefully lowering the chuck 33 to slowly dip the ingot A into the melt M in an appropriate manner in consideration of the surface level B which depends on how the melt M of the furnace 3 is supplied to the die cast machine 16. For example, the chuck pressing cylinder 42 may be continuously lowered at an extreme lower speed than till then, or may be intermittently lowered. In this intermittent lowering control, a critical lowered surface level B may be detected to start slowly lowering the ingot A, which may be kept until a recovered threshold level is detected to stop the ingot A. As the surface level B is lowered from the recovered level to the critical level by melt supply to the die cast machine 16, the lowering of the ingot A may be restarted.

Such lowering movements of the ingot A are performed within a vertical passage through which the receiving case 31 of a channel shape and the ingot guide 7*a* of a tubular shape communicate with each other, and of which clearances to the ingot A are filled with antideflagrant gas G from inside the furnace 3.

When the chuck 33 has reached a predetermined level (at the guide 7*a* of the ingot supply opening 7), most of length of the ingot A is dipped in the magnesium melt M, when the chuck 33 releases the ingot A to be supplied into the melt M.

After the supply, the chuck pressing cylinder 42 goes up at a high speed together with the chuck 33, to return to its original position. Concurrently, the shutter 19 closes the ingot supply opening 7, and the receiving case 31 rotates to return to its original position where it has a substantially horizontal lying attitude. Thereafter, the foregoing actions will be repeated to supply a subsequent preheated ingot A.

According to this embodiment of the invention, in an ingot supply system 1, because an ingot supply opening 7 and a drive mechanism 40 of an ingot supply means 5 are provided on a top cover 8 of a melting and holding furnace 3, their relative positions are fixedly set, without variations due to a disconnection or reconnection of the melting and holding furnace 3 to a die cast machine 16, whereby upon reconnection of the furnace 3 to the die cast machine 16, such as after inspection, it is unnecessary to make a centering of the ingot supply means 5 to the ingot supply opening 7, allowing for an improved production efficiency.

Moreover, in the ingot supply system 1, because of provision of an intermediate handling means 30 having a receiving case 31 adapted for taking a substantially horizontal lying position to enable a lying preheated ingot A to be forwarded in as it is, a preheater 2 can heat a magnesium ingot A1 in a lying position, whereby an ingot A1 transfer means can be constituted in a simple structure using a combination of a chain conveyor 22 and a rod-less cylinder 20, thus allowing for a reduced cost due to the simplification of preheater 2.

Still more, in the ingot supply system 1, because a pawl chuck 33 of an ingot supply means 5 is pressed against a side face of a preheated ingot A accommodated in a receiving case 31 to thereby pinch the ingot A between the chuck 33 and the case 31, even if the ingot A is irregular in size or configuration, it is possible to chuck the ingot A in a practical manner, such as by shifting the chuck 33 in a horizontal pressing direction (arrow "a" in FIG. 6) to cope with an irregular sectional size of ingot A, or by moving a chuck pressing cylinder 42 of a chuck drive 40 to shift the chuck 33 in a vertical direction to cope with an irregular length of ingot A, whereby deviations in size of ingot can be easily coped with.

Yet more, in the ingot supply system 1, an ingot supply opening 7 has a guide 7*a* projecting from underside of a furnace top cover 8 to release a preheated ingot A at a level possibly near to a melt surface level B, thereby reducing the amount of spatters of melt M upon ingot supply, as well as generation of oxides.

Further, in the ingot supply system 1, exposure to a hot atmosphere is limited simply to a chuck 33 that enters backside of a furnace top cover 8, allowing for a drive mechanism 40 of the chuck 33 to be left outside the cover 8, thus avoiding exposure to the atmosphere, whereby an ingot grasping mechanism of an ingot supply means 5 can be improved in durability.

Still further, according to an ingot supplying method employed in the ingot supply system 1, a magnesium ingot A set in a substantially horizontal lying position is preheated in an ingot preheater 2, and forwarded as it is into a receiving case 31 of an intermediate handling means 30, and then changed in position into a vertically standing position by the intermediate handling means 30, before keeping the standing position to enter through an ingot supply opening 7 into a melting and holding furnace 3, whereby the ingot supply opening 7 is allowed to be set smaller in opening area, so that heat dissipation from the furnace 3 is suppressed by a degree commensurate to a reduction in the opening area.

Yet further, in the ingot supplying method, the preheated magnesium ingot A is dipped in a magnesium melt M is performed by a pawl chuck 33 slowly moving vertically downward, successfully suppressing oxidization of magnesium melt M, melt temperature variation, and disturbances of melt surface and antideflagrant gas atmosphere, having a stable magnesium melt temperature, thereby supplying a die cast machine with a stable magnesium melt without non-conforming or varied fluidity, thus leading to die cast products of good quality, in addition to that a magnetic hydraulic pump 6 employed for melt supply in the embodiment implements a better supply of melt to be adequate and precise in shot quantity.

The contents of Japanese Patent Application No. 2000-363375 are incorporated herein by reference.

While preferred emnbodiments of the present invention have been described using specific terms, such description is for illustrative purposes, and it is to be understood that changes and variations may be made without departing from the spirit or scope of the following claims.

What is claimed is:

1. An ingot supplying apparatus for supplying a preheated magnesium ingot from a preheater to a melting and holding furnace, the apparatus comprising:

an ingot supply opening provided to a furnace cover of the melting and holding furnace and with a shutter operable to open and close by an external signal;

an intermediate handler having a receiving case configured substantially in a channel shape open at both ends thereof, and pivoted on the furnace cover to be movable between a substantially horizontal lying position with one end thereof coincident with a ingot exit of the preheater to allow for a preheated ingot to be forward therein in a lying position with a longitudinal axis thereof set substantially horizontal and a substantially vertical standing position with the other end thereof coincident with the ingot supply opening to bring a distal end of the preheated ingot forwarded therein into abutment with the shutter to make the preheated ingot stand thereon; and an ingot supplier having a pawl chuck configured to enter inside the receiving case from an open side of the receiving case in the substantially vertical standing position, to be pressed against a rear end part of the preheated ingot as accommodated, and attached to, for a vertically guiding by, a drive mechanism fixed at a base end thereof to the furnace cover, and adapted for the shutter to be opened and the pawl chuck to be lowered to supply the preheated ingot into the melting and holding furnace.

2. An ingot supplying apparatus according to claim 1, wherein the ingot supply opening comprises a guide part projecting from a backside of the furnace cover.

3. An ingot supplying apparatus according to claim 1, wherein the pawl chuck comprises pawls provided to a distal end of a connection rod connected at a base end thereof to the drive mechanism.

* * * * *

UNITED STATES PATENT AND TRADEMARK OFFICE

CERTIFICATE OF CORRECTION

PATENT NO. : 6,557,619 B2
DATED : May 6, 2003
INVENTOR(S) : Shinichi Katoh

It is certified that error appears in the above-identified patent and that said Letters Patent is hereby corrected as shown below:

Title page,
Item [73], Assignee, "Toshiba, Kikai Kabushiki Kaisha," should read -- Toshiba Kikai Kabushiki Kaisha, --.
Item [57], ABSTRACT,
Line 23, "melding" should read -- melting --.

Column 8,
Line 52, "a ingot" should read -- an ingot --.

Signed and Sealed this

Twenty-third Day of September, 2003

JAMES E. ROGAN
*Director of the United States Patent and Trademark Office*